US005692605A

United States Patent [19]

Lai

[11] Patent Number: 5,692,605

[45] Date of Patent: Dec. 2, 1997

[54] JEWELRY BOX WITH A LINKING ASSEMBLY WHICH PERMITS HANGING OF JEWELRY THEREON

[76] Inventor: Yung-Tsai Lai, No. 42, Lane 408, Tung-Kuang Rd., Taichung City, Taiwan

[21] Appl. No.: 715,518

[22] Filed: Sep. 18, 1996

[51] Int. Cl.[6] ..... A45C 11/04

[52] U.S. Cl. ..... 206/6.1; 206/566; 220/522; 217/60 E

[58] Field of Search ..... 206/6.1, 566; 220/522; 217/60 E, 60 G; 47/60 R

[56] References Cited

U.S. PATENT DOCUMENTS

| | | | |
|---|---|---|---|
| 2,950,003 | 8/1960 | Simmons et al. | 206/566 |
| 2,962,156 | 11/1960 | Adams | 206/566 |
| 3,563,592 | 2/1971 | Preston | 217/60 |
| 4,114,235 | 9/1978 | Remington | 217/60 E |
| 4,787,516 | 11/1988 | Morrison | 206/566 |
| 4,867,494 | 9/1989 | Castiglioni | 217/60 E |
| 4,940,267 | 7/1990 | Shieh | 217/60 |

*Primary Examiner*—Paul T. Sewell
*Assistant Examiner*—Nhan T. Lam
*Attorney, Agent, or Firm*—Banner & Witcoff, Ltd.

[57] ABSTRACT

A jewelry box includes an upper cover member with a rim and a lower container body with a surrounding wall. The rim of the upper cover member is hinged to a top edge of the surrounding wall of the lower container body in such a manner that the upper cover member is turnable from a closed position in which the upper cover member is superimposed on the lower container body, to an open position in which the upper cover member permits access into the lower container body. The jewelry box further includes a linking assembly having a pair of upper linking arms, a pair of lower linking arms and at least one elongated horizontal hanging bar. Each of the upper linking arms has an upper end pivoted to an inner side of the rim of the upper cover member, and a lower end. Each of the lower linking arms has an upper end pivoted to the lower end of one of the upper linking arms, and a lower end pivoted to an inner side of the surrounding wall of the lower container body. The elongated horizontal hanging bar has two end portions mounted on one of the pairs of upper and lower linking arms. The hanging bar is used to hang jewelry thereon.

5 Claims, 6 Drawing Sheets

JEWELRY BOX WITH A LINKING ASSEMBLY WHICH PERMITS HANGING OF JEWELRY THEREON

BACKGROUND OF THE INVENTION

1. Field of the Invention

The present invention relates to a jewelry box, more particularly to a jewelry box with a linking assembly which permits hanging of jewelry thereon.

2. Description of the Related Art

FIG. 1 illustrates a conventional jewelry box 10 which includes an upper cover member 12 with a rim 15 and a lower container body 13 with a surrounding wall 11. The rim 15 of the upper cover member 12 is hinged to a top edge of the surrounding wall 11 of the lower container body 13 in such a manner that the upper cover member 12 is turnable from a closed position in which the upper cover member 12 is superimposed on the lower container body 13, to an open position in which the upper cover member 12 permits access into the lower container body 13. The lower container body is formed with a plurality of compartments for placing jewelry, such as rings, earrings, necklaces, etc., therein. Although the conventional jewelry box 10 permits the placing of jewelry therein, it has the following drawbacks:

The compartments for receiving jewelry are generally provided in the lower container body 13. The upper cover member 12 is only used for covering the lower container body 13 and is not efficiently utilized. The capacity of the jewelry box 10 is thus severely limited. Certain jewelry, such as necklaces and earrings, which are possibly placed in the same compartment due to the limited capacity that is provided, are liable to get entangled with each other. This results in inconvenience for the consumer.

SUMMARY OF THE INVENTION

The main object of this invention is to provide a jewelry box with a linking assembly which permits hanging of jewelry thereon.

Accordingly, the jewelry box of this invention includes an upper cover member with a rim and a lower container body with a surrounding wall. The rim of the upper cover member is hinged to a top edge of the surrounding wall of the lower container body in such a manner that the upper cover member is turnable from a closed position in which the upper cover member is superimposed on the lower container body, to an open position in which the upper cover member permits access into the lower container body. The jewelry box is further provided with a linking assembly which includes a pair of upper linking arms, a pair of lower linking arms and at least one .elongated horizontal hanging bar. Each of the pair of upper linking arms has an upper end pivoted to an inner side of the rim of the upper cover member, and a lower end. Each of the lower linking arms has an upper end pivoted to the lower end of a respective one of the upper linking arms, and a lower end pivoted to an inner side of the surrounding wall of the lower container body. The hanging bar has two end portions mounted on one of the pairs of upper and lower linking arms. The hanging bar is formed with means for hanging jewelry thereon. Therefore, the jewelry box according to this invention is capable of receiving more jewelry than the conventional ones. The jewelry box of this invention achieves not only the purpose of receiving jewelry, but also the function of displaying jewelry which are hung on the linking assembly thereof. When the upper cover member is turned to the open position to permit access into the lower container, the jewelry on the linking assembly are displayed.

BRIEF DESCRIPTION OF THE DRAWINGS

Other features and advantages of this invention will become apparent in the following detailed description of the preferred embodiments with reference to the accompanying drawings, of which.

DETAILED DESCRIPTION OF THE PREFERRED EMBODIMENTS

Figure 1:
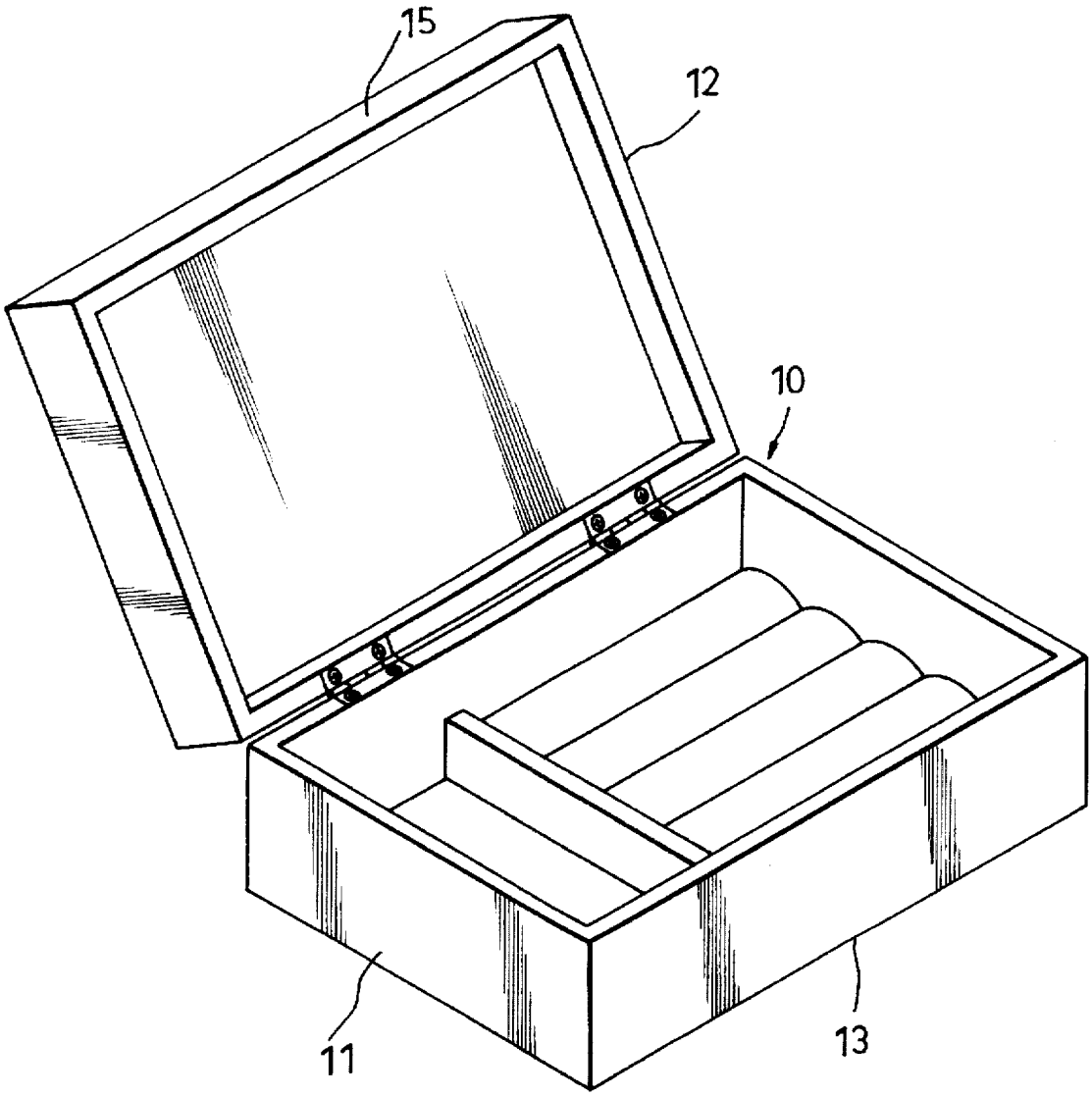
FIG.1 PRIOR ART
FIG. 1 is a perspective view illustrating a conventional jewelry box.

Before this invention is described in greater detail, it should be noted that like elements are indicated by the same reference numerals throughout the disclosure.

Figure 2:
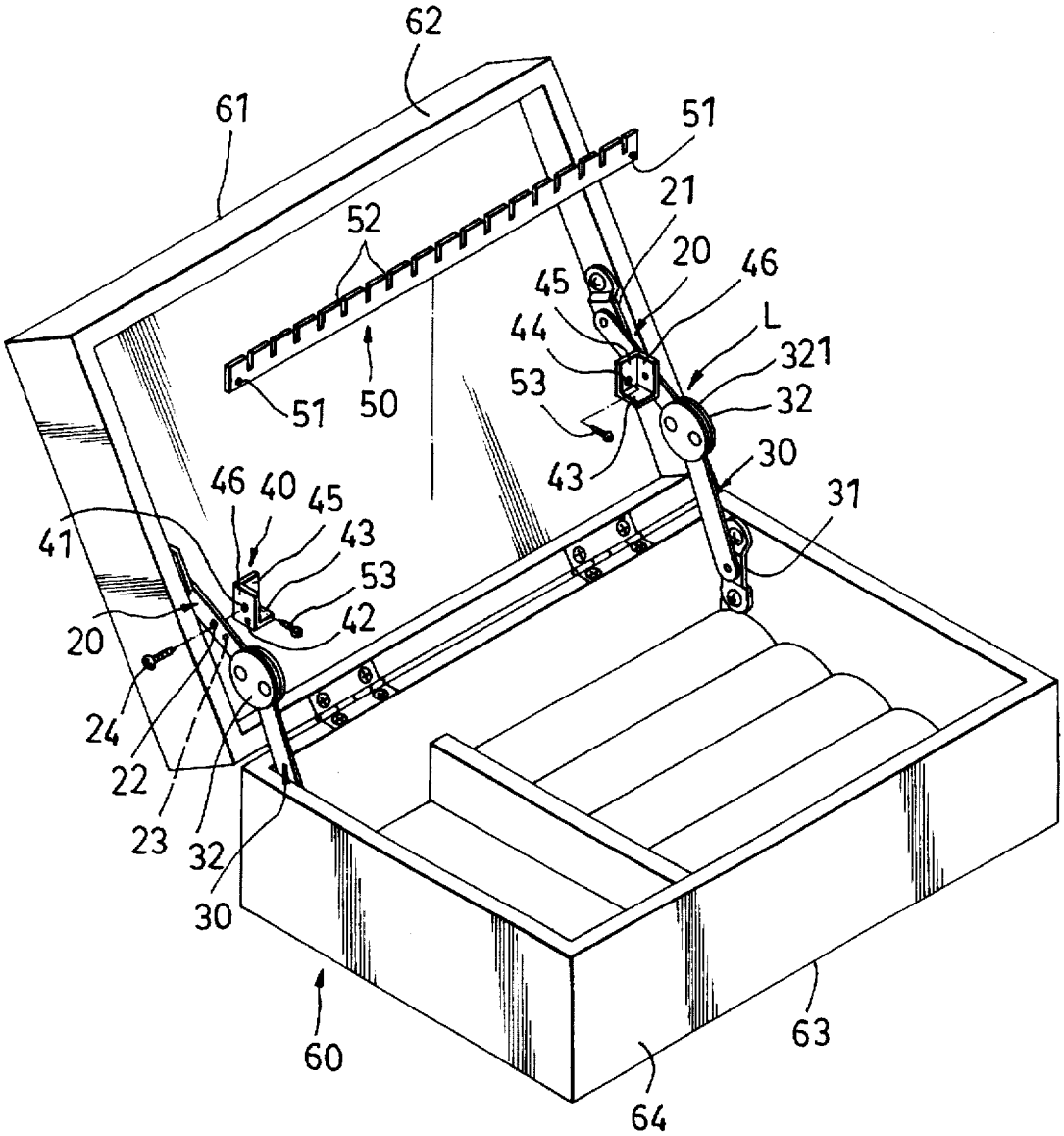
FIG. 2 is an exploded perspective view of a first preferred embodiment of the jewelry box according to this invention.
Figure 3:
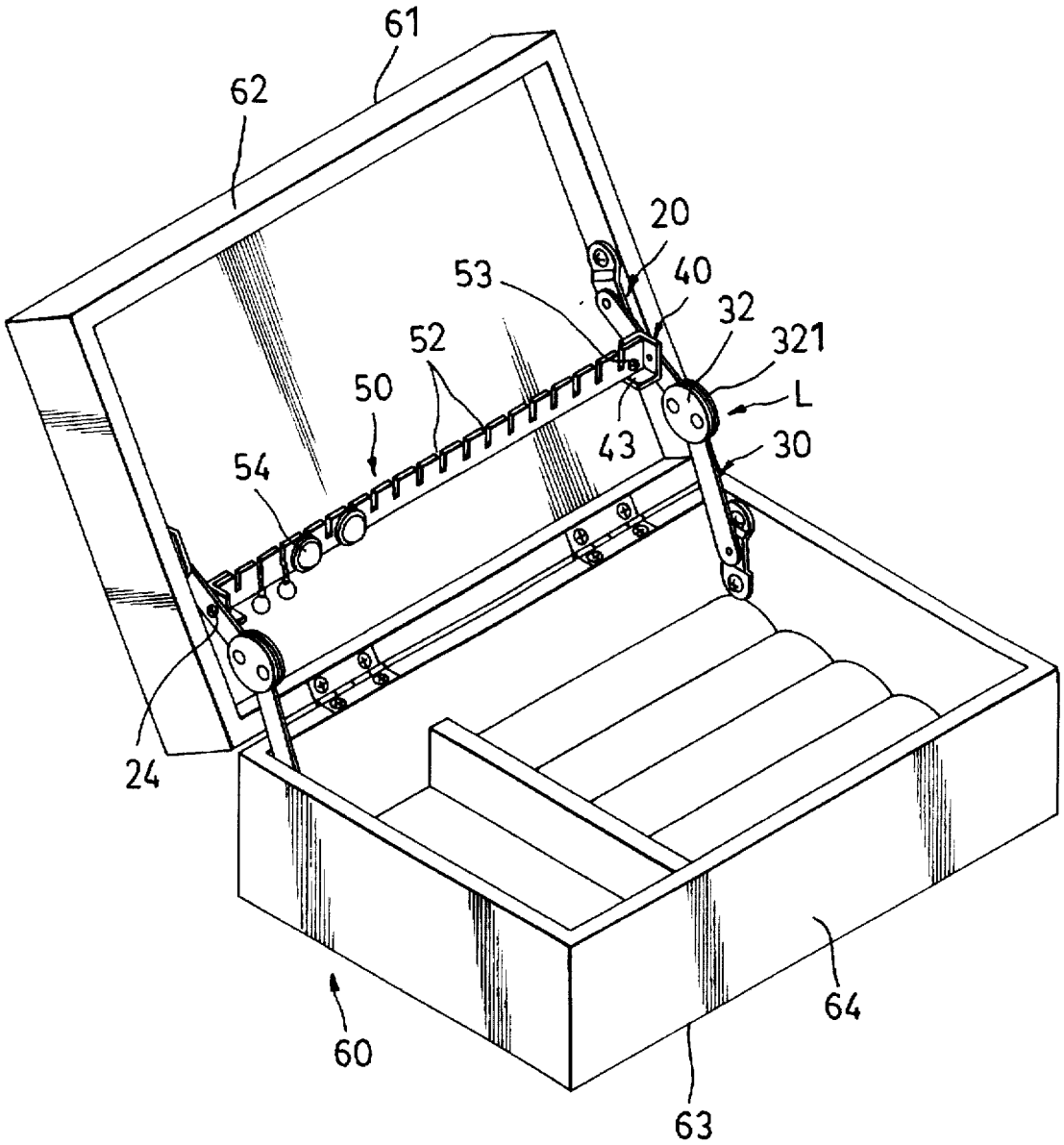
FIG. 3 illustrates how jewelry is hung on the linking assembly of the jewelry box shown in FIG. 2.

Referring to FIGS. 2 and 3, the first preferred embodiment of the jewelry box 60 according to this invention is shown to include an upper cover member 61 with a rim 62 and a lower container body 63 with a surrounding wall 64. The rim 62 of the upper cover member 61 is hinged to a top edge of the surrounding wall 64 of the lower container body 63 in such a manner that the upper cover member 61 is turnable from a closed position in which the upper cover member 61 is superimposed on the lower container body 63, to an open position in which the upper cover member 61 permits access into the lower container body 63. The jewelry box 60 further includes a linking assembly (L) with a pair of upper linking arms 20, a pair of lower linking arms 30 and an elongated horizontal hanging bar 50.

Each of the pair of upper linking arms 20 has an upper end pivoted to a respective upper mounting plate 21 that is mounted on an inner side of the rim 62 of the upper cover member 61, and a lower end pivoted to a circular pivot unit 32. Each pivot unit 32 is formed with a peripheral groove 321. The lower end of each of the upper linking arms 20 extends into the peripheral groove 321 of the respective pivot unit 32. Each of the pair of upper linking arms 20 is formed with a through hole 22 and a recess 23 adjacent to the through hole 22.

Each of the pair of lower linking arms 30 has an upper end that is pivoted to the respective pivot unit 32 and that extends into the peripheral groove 321 of the pivot unit 32, and a lower end pivoted to a respective lower mounting plate 31 that is mounted on an inner side of the surrounding wall 64 of the lower container body 63.

The elongated hanging bar 50 has two end portions, each of which is formed with a mounting hole 51 and is provided with a positioning member 40 that is mounted on one of the pairs of upper linking arms 20. The hanging bar 50 has an upper longitudinal edge formed with a plurality of notches 52 for retaining jewelry therein.

Each of the positioning members 40 has a rear wall part 45 formed with a positioning hole 44 that is registered with the mounting hole 51 in a respective end portion of the elongated hanging bar 50. The rear wall part 45 of each of the positioning members 40 is mounted on a respective end portion of the hanging bar 50 by means of a screw 53. Each of the positioning members 40 further has a side wall part 46 that is connected to the rear wall part 45 to form a substantially L-shaped structure. The side wall part 46 of each of the positioning members 40 is formed with a screw hole 41 that is registered with the through hole 22 formed in a respective one of the upper linking arms 20, and a protrusion 42 that is received in the recess 23 formed in a respective one of the upper linking arms 20. The side wall part 46 of each of the positioning members 40 is mounted on an inner side of a respective upper linking arm 20 by means of a bolt 24. The rear wall part 45 and the side wall part 46 of each of the positioning members 40 have bottom edges. Each of the positioning members 40 further includes a base plate 43 which interconnects the bottom edges of the rear and side wall parts 45, 46 for supporting a respective end portion of the hanging bar 50 thereon.

To assemble the jewelry box 60 according to this invention, the positioning members 40 are respectively brought to the inner sides of the upper linking arms 20 such that the screw holes 41 are respectively registered with the through holes 22 and that the protrusions 42 are respectively received in and engage the recesses 23. The bolt 24 is passed through the through hole 22 to engage the screw hole 41 so as to mount one of the positioning members 40 on the inner side of a respective one of the upper linking arms 20. The upper and lower mounting plates 21 and 31 provided on the upper and lower linking arms 20 and 30 are respectively fastened to the inner sides of the rim 62 of the upper cover member 61 and the surrounding wall 64 of the lower container body 63 in such a manner that the each pair of upper and lower linking arms 20 and 30 are disposed oppositely at the inner side of the jewelry box 60. The upper and lower linking arms 20 and 30 are folded when the jewelry box 60 is closed and are unfolded when the jewelry box 60 is opened. The two end portions of the elongated hanging bar 50 are subsequently disposed on the base plates 43 of the positioning members 40 and are mounted thereon by means of screw fasteners 53, each of which extends through the positioning hole 44 and engages the mounting hole 51. The hanging bar 50 is now ready for hanging jewelry, such as earrings 54, thereon.

Figure 4:
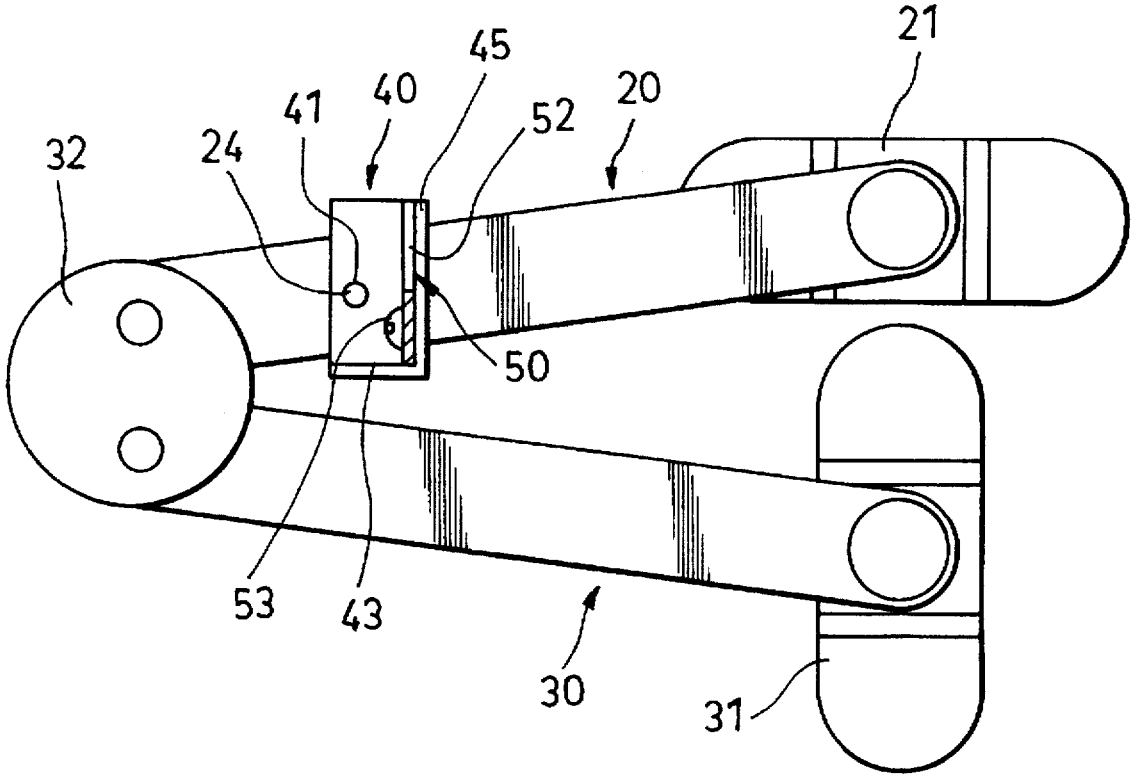
FIG. 4 is a cross-sectional view illustrating the linking assembly of the jewelry box shown in FIG. 2.

Therefore, when the upper cover member 61 is turned to the open position, the upper and lower linking arms 20 and 30 are unfolded so as to display the earrings 54 on the hanging bar 50, as shown in FIG. 3. In contrast, when the upper cover member 61 is turned to the closed position, as shown in FIG. 4, the hanging bar 50 is folded together with the upper and lower linking arms 20 and 30. During the folding and unfolding of the linking assembly (L), the rear walls 45 of the positioning members 40 are kept substantially vertical so that the earrings 54 on the hanging bar 50 do not drop off.

Figure 5:
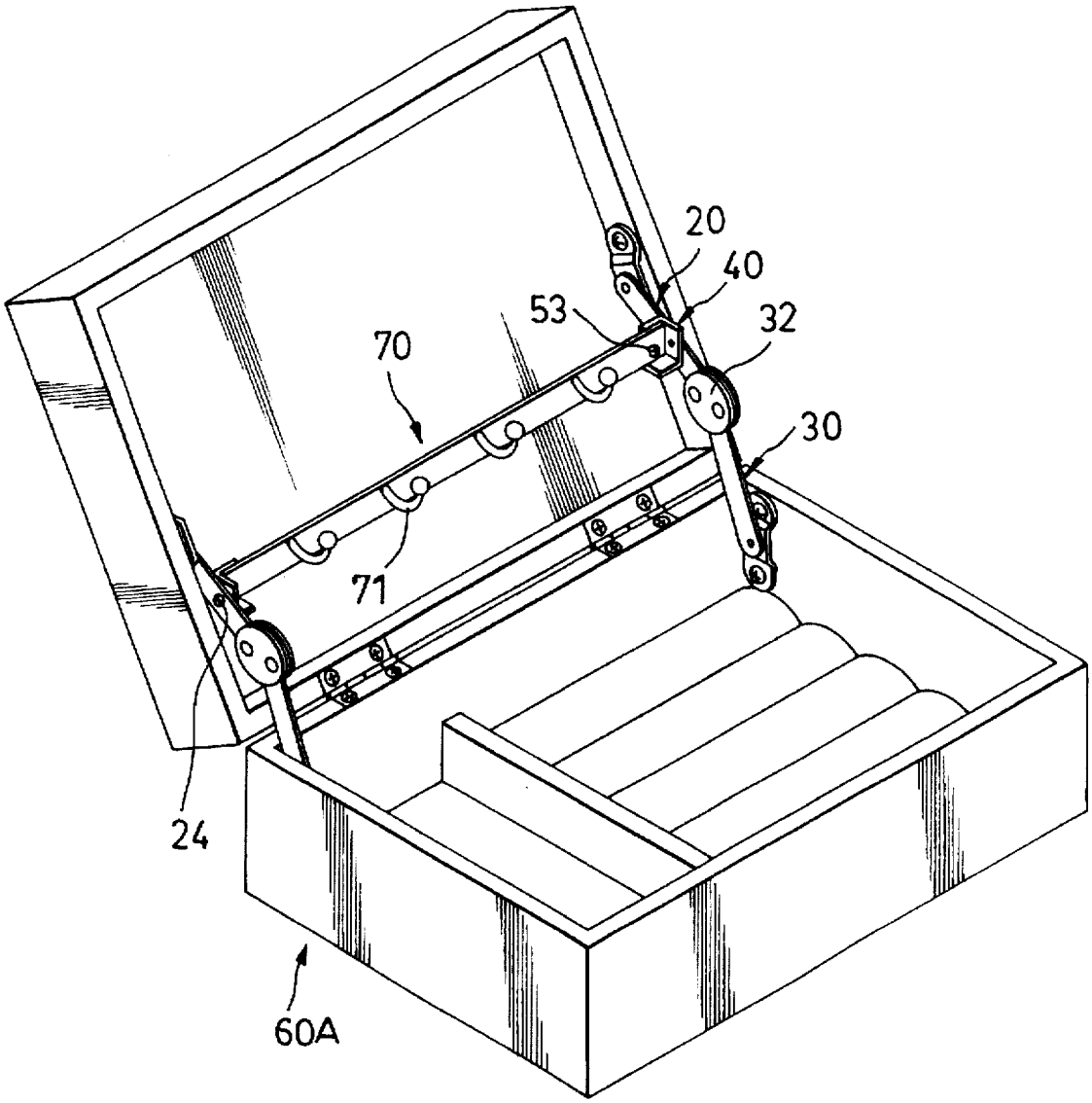
FIG. 5 is a perspective view of a second preferred embodiment of the jewelry box according to this invention.

FIG. 5 illustrates a second preferred embodiment of the jewelry box 60A according to this invention. Instead of notches, the hanging bar 70 is formed with a plurality of forwardly extending hook projections 71 for hanging jewelry, such as necklaces, thereon.

Figure 6:
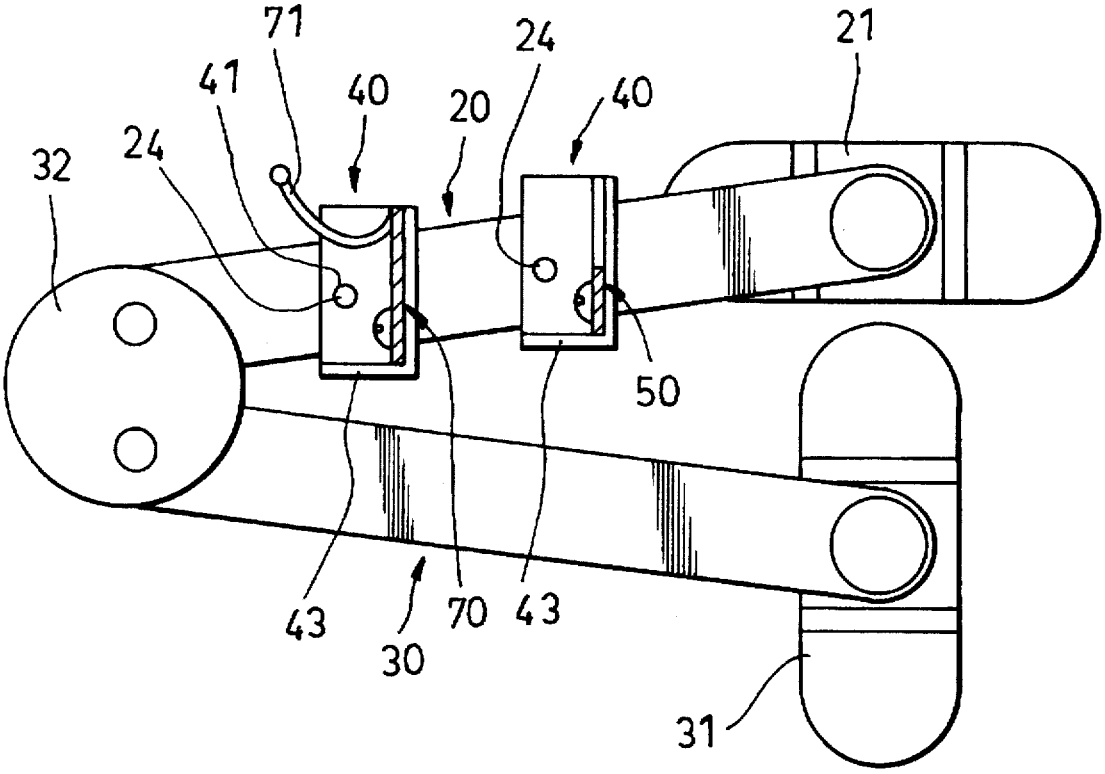
FIG. 6 is a cross-sectional view illustrating the linking assembly of a third preferred embodiment of the jewelry box according to this invention.

FIG. 6 shows a third preferred embodiment of the jewelry box according to this invention. Note that the linking assembly of the jewelry box of this embodiment includes both the hanging bar 50 for hanging earrings and the hanging bar 70 for hanging necklaces. In this situation, two pairs of positioning members 40 are necessary for mounting the hanging bars 50, 70 on the upper linking arms 20. Moreover, it is possible to mount a plurality of hanging bars 50 or 70 on both the upper and lower linking arms 20 and 30 if sufficient space is provided in the jewelry box.

With the use of the jewelry box of this invention, the upper cover member is efficiently used to increase the capacity of the jewelry box. The jewelry box according to this invention also achieves the function of displaying jewelry and is therefore more convenient and practical to use.

With this invention thus explained, it is apparent that numerous modifications and variations can be made without departing from the scope and spirit of this invention. It is therefore intended that this invention be limited only as indicated in the appended claims.

I claim:

1. A jewelry box including an upper cover member with a rim and a lower container body with a surrounding wall, said rim of said upper cover member being hinged to a top edge of said surrounding wall of said lower container body in such a manner that said upper cover member is turnable from a closed position in which said upper cover member is superimposed on said lower container body, to an open position in which said upper cover member permits access into said lower container body, wherein said jewelry box further includes a linking assembly, said linking assembly comprising:

a pair of upper linking arms, each of which has an upper end pivoted to an inner side of said rim of said upper cover member, and a lower end;

a pair of lower linking arms, each of which has an upper end pivoted to said lower end of one of said upper linking arms, and a lower end pivoted to an inner side of said surrounding wall of said lower container body; and at least one elongated horizontal hanging bar having two end portions mounted on one of said pairs of upper and lower linking arms, said hanging bar being formed with means for hanging jewelry thereon, each of said two end portions of said hanging bar being provided with a positioning member which has a rear wall part that is mounted on said hanging bar and a side wall part that is connected to said rear wall part to form a substantially L-shaped structure and that is mounted on an inner side of a corresponding one of said upper and lower linking arms.

2. The jewelry box according to claim 1, wherein said side wall part of said positioning member is formed with a screw hole and a protrusion, said corresponding one of said upper and lower linking arms being formed with a through hole that is registered with said screw hole and a recess for receiving said protrusion, said hanging bar being provided with a pair of screw fasteners, each of which extends through said through hole in one of said positioning members and engages said screw hole in said corresponding one of said upper and lower linking arms for mounting said hanging bar on said one of said pairs of upper and lower linking arms.

3. The jewelry box according to claim 2, wherein said rear wall part and said side wall part of said positioning member have bottom edges, said positioning member further having a base plate which interconnects said bottom edges of said rear and side wall parts for supporting a respective one of said end portions of said hanging bar thereon.

4. The jewelry box according to claim 1, wherein said hanging bar has an upper longitudinal edge, said hanging means on said hanging bar including a plurality of notches formed in said upper longitudinal edge for retaining jewelry therein.

5. The jewelry box according to claim 1, wherein said hanging means on said hanging bar includes a plurality of forwardly extending hook projections for hanging jewelry thereon.

* * * * *